United States Patent [19]

Clemens et al.

[11] 4,091,776

[45] May 30, 1978

[54] FLUID ACTUATED TIMING MECHANISM

[75] Inventors: James D. Clemens, Marina del Rey, Calif.; Elmer A. Williams, San Angelo, Tex.

[73] Assignee: Rockwell International Corporation, El Segundo, Calif.

[21] Appl. No.: 457,954

[22] Filed: Apr. 4, 1974

[51] Int. Cl.[2] ..... F01L 1/34; F01L 1/24

[52] U.S. Cl. ..... 123/90.15; 123/90.18

[58] Field of Search ..... 123/90.15, 90.18, 117, 123/148 R, 99, 195 A; 64/25

[56] References Cited

U.S. PATENT DOCUMENTS

| | | | |
|---|---|---|---|
| 2,159,017 | 5/1939 | Duncan | 123/90.15 |
| 2,162,243 | 6/1939 | Browne | 123/90.15 |
| 2,708,353 | 5/1955 | Brady | 64/25 |
| 2,804,061 | 8/1957 | Gamble | 123/90.15 |
| 2,861,557 | 11/1958 | Stolte | 123/90.15 |
| 2,888,000 | 5/1959 | Winkler | 123/140 MC |
| 3,401,572 | 9/1968 | Bailey | 123/90.15 |
| 3,626,720 | 12/1971 | Meacham | 123/90.15 |
| 3,685,499 | 8/1972 | Meacham | 123/90.15 |
| 3,721,220 | 3/1973 | Garcea | 123/90.15 |
| 3,827,413 | 8/1974 | Meacham | 123/90.18 |
| 3,978,831 | 9/1976 | Yoshikawa | 123/117 A |

*Primary Examiner*—Charles J. Myhre
*Assistant Examiner*—R. A. Nelli
*Attorney, Agent, or Firm*—Charles T. Silberberg

[57] ABSTRACT

A timing mechanism actuated by hydraulic fluid uses a means responsive to vacuum to relatively displace a drive member and a driven member. When incorporated in an internal combustion engine for advancing or retarding an engine camshaft with respect to an engine crankshaft, the relative displacement is selectively controlled to reduce smog-producing exhaust emission and improve engine performance and fuel economy. In the preferred embodiment, the drive member and driven member form a fluid pressure chamber therebetween and the vacuum responsive means regulates the hydraluic fluid in said chamber. A vacuum control means which is responsive to engine operating conditions governs the application of vacuum to the vacuum responsive means. When engine operating conditions are at certain specified levels, a signal is transmitted to actuate the vacuum control means to allow the application of vacuum to the vacuum responsive means. With the application of sufficient vacuum, the vacuum responsive means allows hydraulic fluid into the chamber whereby the drive member and driven member are relatively displaced.

16 Claims, 9 Drawing Figures

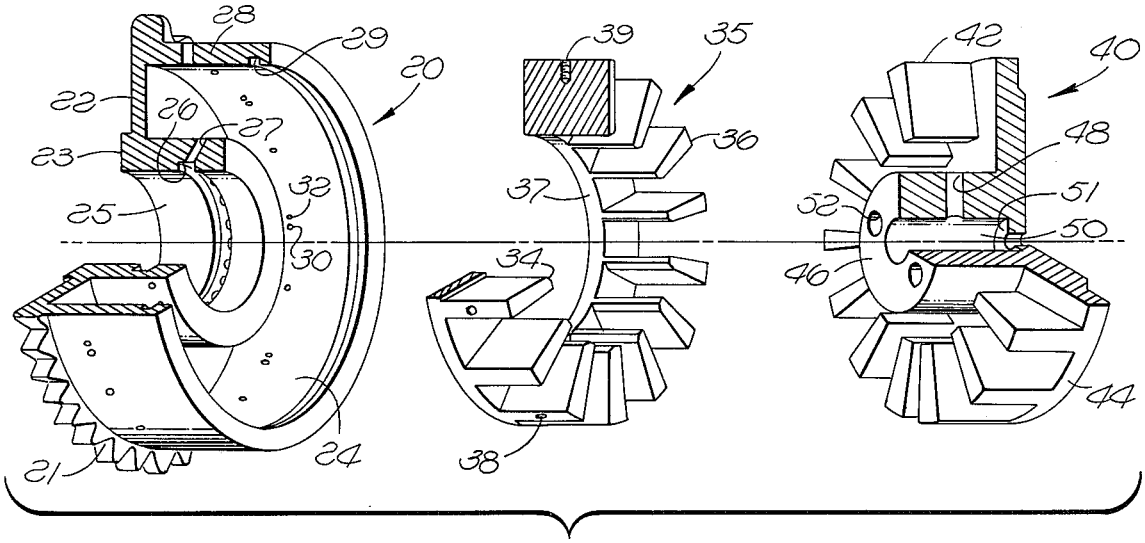
FIG. 2.
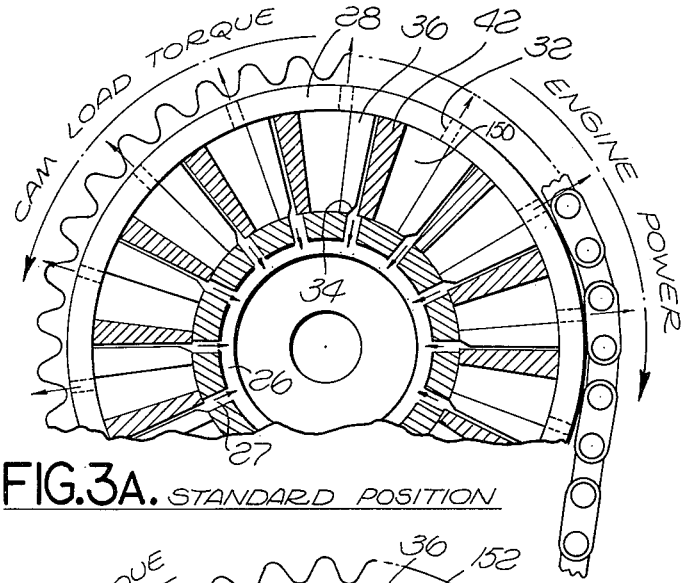
FIG.3A. STANDARD POSITION
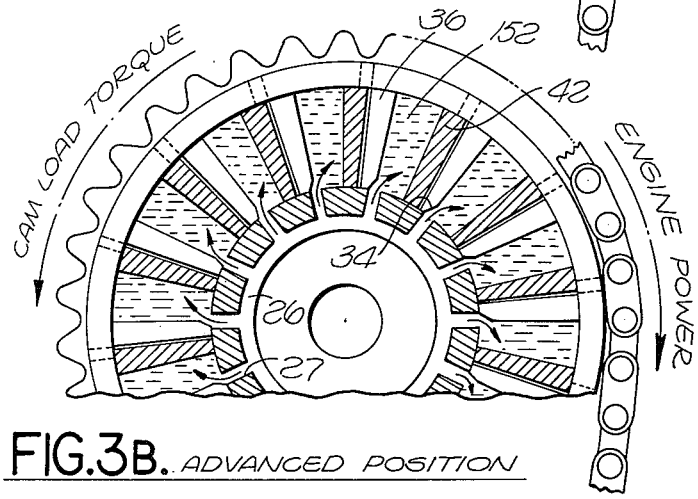
FIG.3B. ADVANCED POSITION
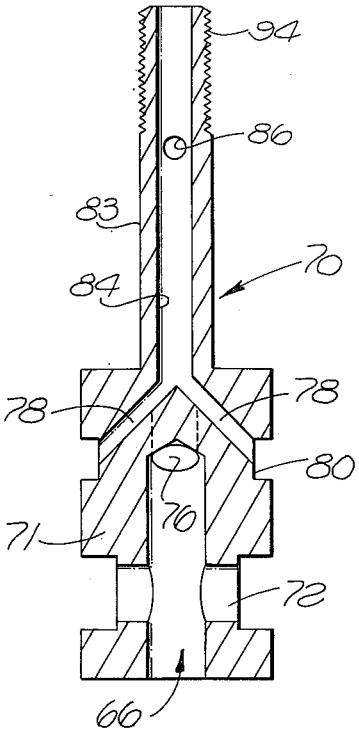
FIG. 4.

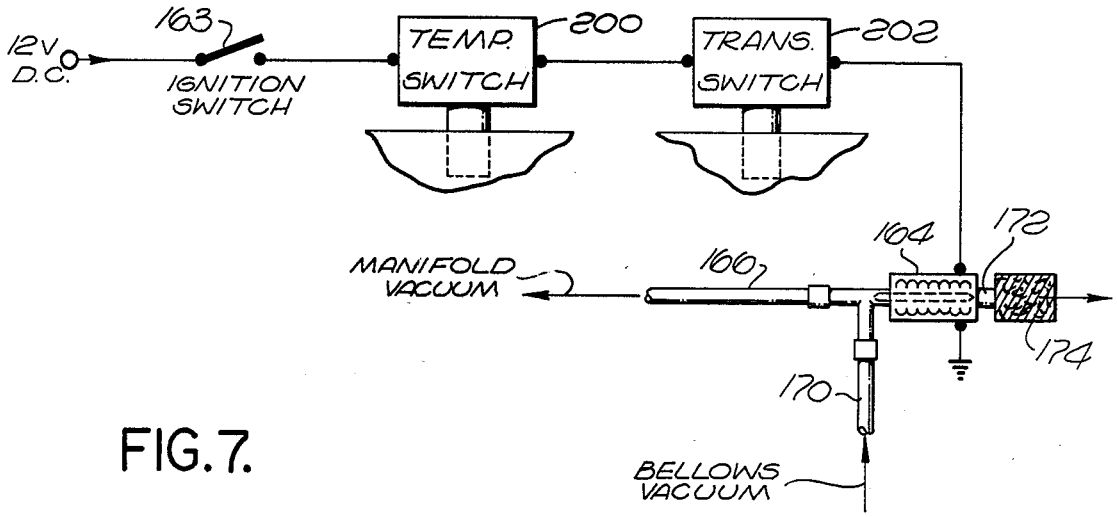
FIG. 7.
FIG. 8.
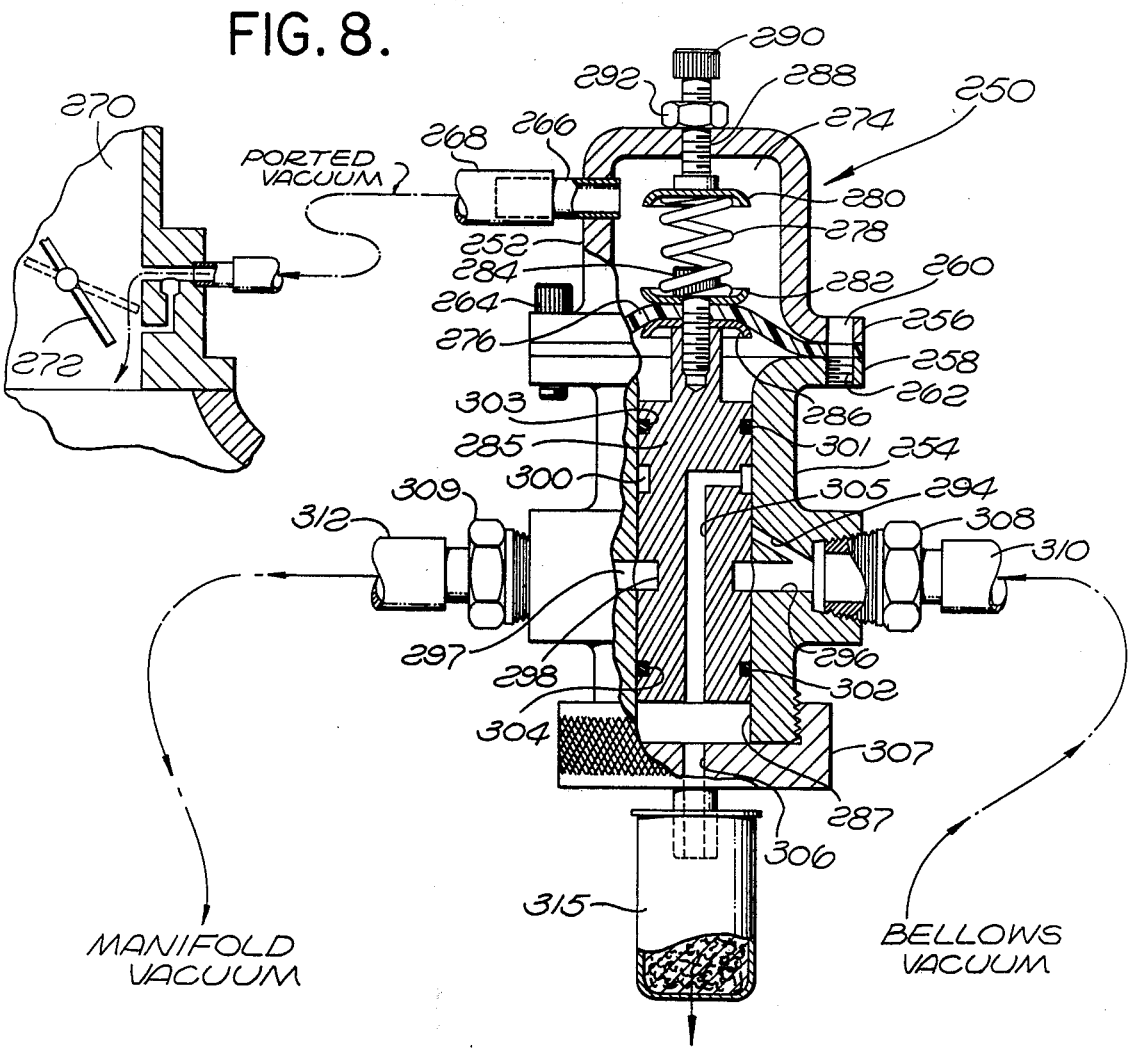

FLUID ACTUATED TIMING MECHANISM

BACKGROUND OF THE INVENTION

This invention relates generally to a hydraulic timing mechanism to relatively displace a drive member and a driven member. More particularly the present invention concerns advancing and/or retarding the camshaft of an internal combustion engine of a vehicle relative to the engine crankshaft where the relative displacement occurs only during certain specified engine operating conditions. The standard position is maintained or returned to when the specified conditions are not met.

Thus, at lower engine temperatures, or at low vehicle speed, or when acceleration is required the timing mechanism would be in the standard position. When conditions are sufficiently changed, an alternate position is effected by the mechanism causing the relative displacement of the drive and driven members to a more efficient position.

Other timing mechanisms for relatively displacing the engine camshaft and crankshaft have been devised. For example, U.S. Pat. No. 2,159,017 to Duncan, in which hydraulic fluid pumped in proportion to engine speed displaces a piston a distance dependent on flow rate. The piston is mechanically linked to the camshaft and so the piston displacement results in a proportional relative displacement of the camshaft. Engine intake vacuum is used to modify the fluid pressure against the piston by opening an additional port and thereby decreasing the fluid pressure against the piston when intake vacuum is insufficient to overcome a spring force. In U.S. Pat. No. 2,162,243 to Brown, the axial shifting of a piston by mechanical linkage, which is independent upon fluid pressure on both sides of the piston, causes a displacement of the drive and driven members. Pressure on one side is determined by intake manifold vacuum responsive valve, and on the other side by an engine speed responsive valve. U.S. Pat. No. 2,861,557 to Stolte discloses a timing mechanism which utilizes a hydraulic linkage for the relative displacement. This mechanism utilizes a valve responsive to centrifugal force which is a function of engine speed. The valve, when engine speed increases, lessens or closes an escape port thereby increasing the pressure of fluid between the drive and driven vanes resulting in a relative displacement of said drive and driven vanes.

The above patents illustrate the need for a timing mechanism to advance and/or retard the engine camshaft with respect to the engine crankshaft under certain operating conditions. However, these inventions have not been commercially practical. The timing of the advance or retard has not been optimized because the prior art inventions have been responsive to only a limited number of engine operating conditions. When responsive to the amount of both intake manifold vacuum and engine speed, the invention as shown by the Duncan and Brown patents has been unduly complicated, expensive, subject to wear, and not adaptable for easy retrofit to an internal combustion engine. Because of these negative factors, it was prior to applicant's invention not deemed practical to make these devices responsive to other significant operating vehicles, namely engine temperature and vehicle speed (when the engine is incorporated in a vehicle). The Stolte patent attempted to obviate the problems of a timing mechanism being unduly complicated, expensive, and not adaptable for retrofit to standard engines. However, this device was still relatively expensive, subject to wear due to the constant mechanical movement, and resulted in inefficient timing, it being responsive only to engine speed (i.e., acceleration at higher speeds would be severely hampered).

SUMMARY OF THE INVENTION

It is, therefore, an object of the present invention to provide a relatively simple, inexpensive timing mechanism which is not subject to wear problems, adaptable for retrofit to existing standard engines, that improves performance, increases fuel economy, and lessens harmful exhaust emissions.

It is another object of the present invention to provide a highly efficient timing mechanism which is responsive to a number of engine operating conditions to selectively relatively displace a drive member and a driven member.

It is yet another object of the present invention to provide a timing mechanism which is hydraulically actuated and which uses a vacuum responsive means for regulating the actuation.

It is still another object of the present invention to provide a hydraulically actuated timing mechanism wherein a vacuum control means controls application of vacuum to a vacuum responsive means which regulates the hydraulic actuation of the mechanism.

Briefly, in accordance with the invention, there is provided a timing mechanism actuated by hydraulic fluid for relatively displacing a drive member and a driven member. A vacuum responsive means regulates relative displacement of the drive and driven members. A control means is provided to control the application of vacuum to the vacuum responsive means.

The control means is actuated by a means responsive to engine operating conditions. In one form of the invention this means responsive to engine operating conditions employs switches which are closed when engine operating conditions exceed specified values, thereby allowing a signal to be transmitted to actuate the vacuum control means.

In another form of the invention, the means responsive to engine operating conditions employs a controller which has circuitry for transmitting a signal only when all input signals are within certain fixed ranges.

In the preferred embodiment the timing mechanism is incorporated in a vehicle having an internal combustion engine. The drive member is operatively connected for rotation with the crankshaft and the driven member is operatively connected with the camshaft so that the engine camshaft can be displaced relative to the engine crankshaft.

Other objects and advantages of the invention will become apparent upon reading the following detailed description and upon reference to the drawings.

BRIEF DESCRIPTION OF THE DRAWINGS

FIG. 2 is an exploded perspective view with portions in section of three interfitting rotatable members of the mechanism;

FIG. 3A is a fragmentary sectional view of the drive and driven vanes of the mechanism of FIG. 1 as shown in the standard position taken in the direction of arrows 3—3 of FIG. 1;

FIG. 3B is a fragmentary sectional view of the drive and driven vanes of the mechanism of FIG. 1 as shown in the advanced position and taken in the direction of arrows 3—3 of FIG. 1;

FIG. 4 is a sectional view of the valve of FIG. 1 taken in the direction of arrows 4—4;

FIG. 7 is a diagram of a second embodiment of control for the mechanism;

FIG. 8 is a diagram of a third embodiment of control for the mechanism;

While the invention will be described in connection with the preferred embodiment, it will be understood that it is not intended to limit the invention to those embodiments. On the contrary, it is intended to cover all alternatives, modifications, and equivalents that may be included within the spirit and scope of the invention as defined by the appended claims.

DETAILED DESCRIPTION OF THE INVENTION

Figure 1:
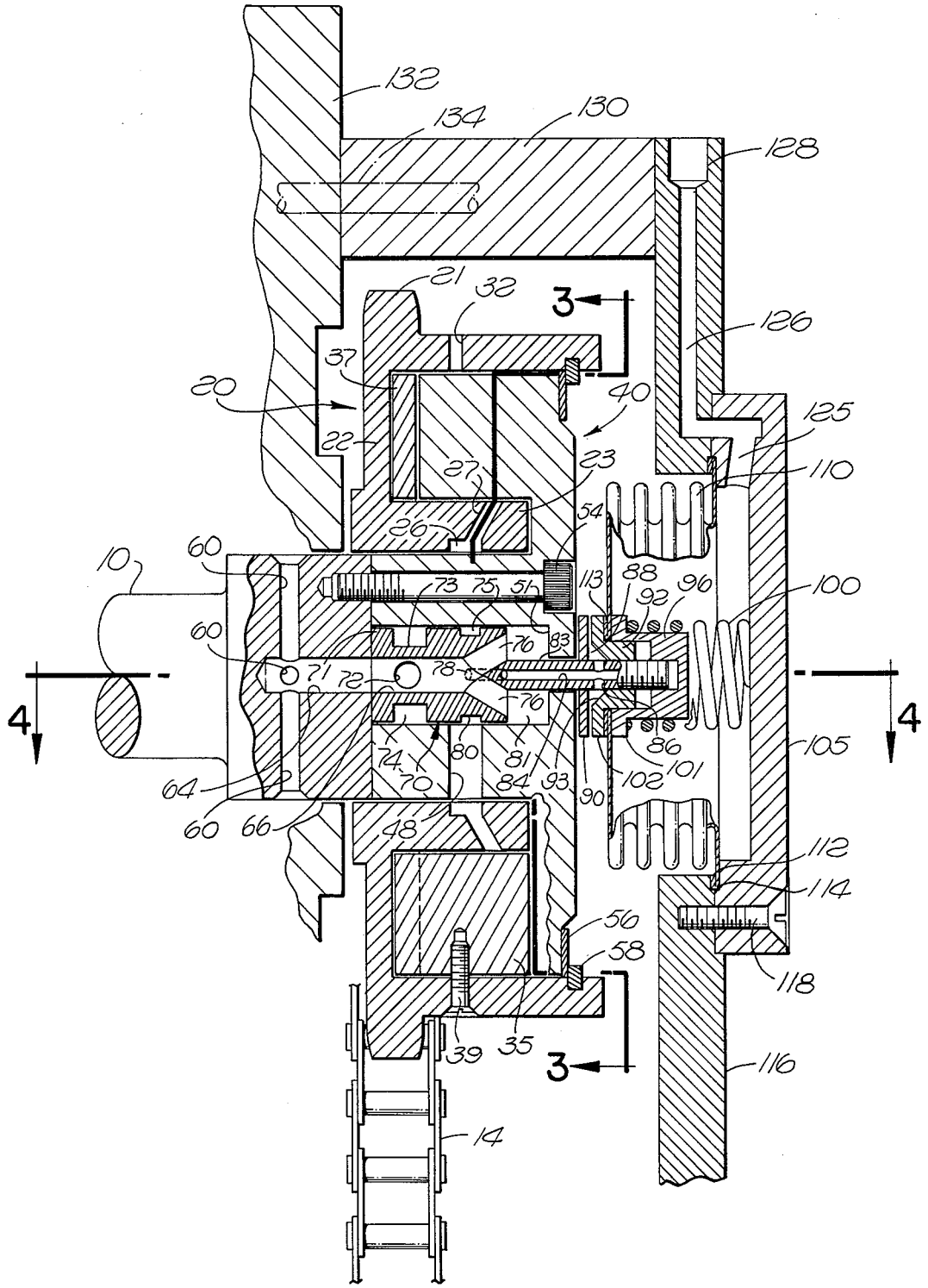
FIG. 1 is a sectional view of the timing mechanism as applied to the camshaft of an internal combustion engine.

Turning first to FIG. 1, the timing mechanism is shown functionally attached to the camshaft 10 of a vehicle internal combustion engine. The camshaft 10 is driven in timed relation to the engine crankshaft (not shown) through the timing mechanism, the latter serving to control the operating relationship between the two shafts by varying the position of the camshaft rotatably as required by operating conditions. To effectuate this control, the timing mechanism is comprised of three major rotatable portions: a sprocket 20, vane ring 35, and hub ring 40.

Sprocket 20 has integrally formed teeth 21 which mesh with a drive chain 14 that is also connected to the engine crankshaft for the drive relationship between the crankshaft, timing mechanism, and camshaft 10.

Referring now to FIG. 2, sprocket 20 which is preferably integrally formed has a hub 23, a parallel outer cylindrical wall 28, and a radial wall 22 connected to the inner ends of hub 23 and wall 28, which form a cavity 24 therebetween. Hub 23 has a circumferential groove 26 and a plurality of channels 27 provided around its outer circumference which connect with groove 26 such that access is provided from cavity 24 to a bore 25 formed by the internal surface of the hub 23. To allow fluid passage from cavity 24 out of the mechanism, holes 32 are provided in the wall 28. Holes 30, also formed in wall 28, are provided for connection of the vane ring 35 to sprocket 20.

Vane ring 35 is made up of a ring 37 with a plurality of equi-spaced driving vanes 36 which may be integrally formed with the ring. The radially extending length of vanes 36 is substantially equal to the difference between the outer and inner radii of cavity 24. Vanes 36, at their inner end are provided with a beveled edge 34. Vane ring 35 is positioned in cavity 24 of sprocket 20 with vanes 36 extending axially and holes 38 in vanes 36 aligned with holes 32 of sprocket 20 so that bolts 39, or other suitable means, can be inserted into the aligned holes to fasten sprocket 20 and vane ring 35.

Hub-ring 40, which is preferably integrally formed, is provided with a hub 46, a ring 44 extending radially outward from hub 46, and a plurality of equi-spaced driven vanes 42, the number of such vanes being equal to the number of driving vanes 36 of vane ring 35. Vanes 42 extend axially within cavity 24 between vanes 36. The radially extending length of vanes 42 is substantially equal to the difference between the outer and inner radii of cavity 24. Vanes 42 are, therefore, circumferentially spaced from and coaxial with vanes 36. Hub 46 is fitted within bore 25 and has an outside diameter substantially equal to the inner diameter of hub 23. Hub 46 defines a central bore 50. The bore 50 is of constant diameter except for the flanged end 51 at the outer end bore 50 which defines a smaller diameter. A plurality of radial passages 48 (preferably two) are provided in hub 46 for fluid flow from bore 50 to cavity 24 through groove 26 and channels 27. A plurality of holes 52 are formed within hub 46 for insertion of bolts 54, or other suitable means, to secure the hub ring 40 to camshaft 10. A spacer ring 56 and snap ring 58 positions hub-ring 40 within sprocket 20.

Referring again to FIG. 1, the camshaft is provided with a plurality of transverse fluid supply passages 60 which terminate radially inward into an axial fluid supply passage 64. Fluid, under pressure, which may be lubricating oil from the engine oil supply, is fed through these passages. Any fluid pressure source is suitable so long as fluid is delivered at a sufficiently high pressure at all engine speeds to overcome the torque transmitted to the camshaft.

Referring now to FIGS. 1 and 4, the hydraulic fluid passes from passage 64 into a central axial bore 66 in sliding pilot valve 70. Valve 70 comprises a portion 71 for fluid delivery which is located at the forward end of the timing mechanism and has a diameter substantially the same as bore 50, and portion 83, located at the rear end of the timing mechanism which is of a diameter substantially the same as the inner diameter of flange 51 of hub ring 40. Valve 70 is circumferentially grooved at 73 and 80, thereby defining annular regions 74 and 75 respectively of bore 50. Fluid can flow from bore 66 through hole 72 into the annular area 74. At the rear end of portion 71, bore 66 is divided into two inclined passages 76. In the position shown in FIG. 1, passages 76 lead to an annular area 81 of bore 50 defined by the outer diameter of portion 83, the diameter of bore 50, and the distance between portion 71 of valve 70 and flange 51. Fluid access from annular area 75 to portion 83 is provided by two inclined passages 78. Passages 78 merge into an axial bore 84 of portion 83. Fluid flowing through bore 84 exits from the valve through hole 86. A space 88 is provided between washer 90 and retainer 92 for flow of the fluid from hole 86 back to the fluid supply. Retainer 92 is beveled at 93 to enlarge space 88 for easier fluid flow from hole 86.

The outer end of portion 83 of valve 70 is threaded at 94 to fit within retainer 92 and retainer 96. Mounted around retainer 96 is a coil spring 100 which bears against the flanged end 101 of retainer 96 and cover 105. A bellows 110 which is preferably metal, surrounds spring 100 and retainer 96 and has an end 112 retained in a groove 114 between cover 105 and cover 116, and an end 113 retained in the grooved space between flange portions 101 and 102 of retainers 96 and 92. Cover 105 is fastened to cover 116 preferably by a plurality of screws 118. To provide access of vacuum to the bellows 110, a vacuum passage 125 is provided in cover 105. Passage 125 is aligned with and engages vacuum passage 126 at the upper end of cover 105. Passage 126 terminates at the uppermost end of cover 116 in an enlarged vacuum port 128. Cover 116 is suitably connected to a housing 130 which surrounds the timing mechanism, drive chain 14, and the crankshaft sprocket (not shown). Housing 130 is suitably connected as by bolts 135 to engine block 132.

FIGS. 3A and 3B illustrate the movement of vanes 42 of hub-ring 40. During periods when no vacuum is applied to bellows 110 or the amount of vacuum that is applied is insufficient to overcome the force of spring 100, vanes 42 are in the standard position being held by the cam load torque against the vanes 36. When vacuum is applied to the bellows and is sufficient to overcome the force of spring 100, valve 70 moves from the position shown in FIG. 1 to a position where the outer end of portion 71 abuts flange 51 of hub ring 40. This allows fluid to flow from hole 72, through annular area 74, into passages 48, and then into grooves 26 and channels 27. From channels 27, the fluid flows between vanes 36 and vanes 42, the flow being made easier by beveled portion 34 of vanes 36. The force of the fluid, which overcomes the cam load torque, rotates vanes 42 through a fixed amount of travel (shown by spaces 150), as 10 degrees, to where vanes 42 abut the opposite sides of the next succeeding vane 36 as shown by the advanced position of FIG. 3B. When the vacuum is removed or is decreased to an amount where the spring again overcomes the bellows, valve 70 is returned to the position of FIG. 1 where the forward end of portion 71 abuts the edge of the camshaft 82, thereby removing fluid pressure from the chamber 152 formed between vanes 36 and 42. With the fluid pressure removed, the camload torque causes the vanes 42 to move towards the original standard position. The fluid in chambers 150 is forced through channels 27, groove 26, passages 48, and into passages 78 from where the fluid is drawn through bore 84, hole 86, and space 88 to the original supply. Any fluid that becomes trapped in chamber 52 due to seepage (the seepage having the beneficial effect of lubricating the moving parts of the mechanism and preventing wear thereby) passes through the relief holes 32 by centrifugal force and returns to the fluid supply.

Figure 5:
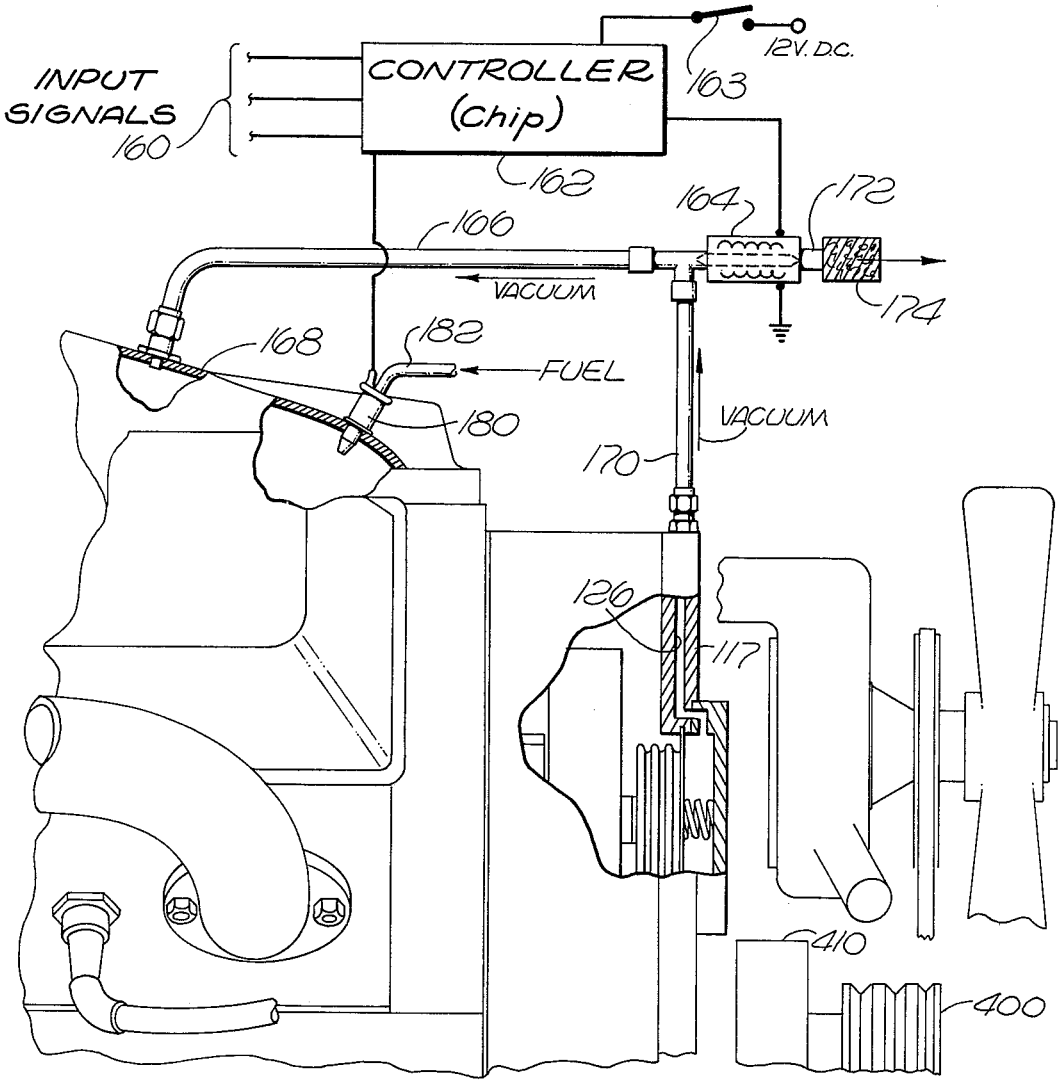
FIG. 5 is a diagram of the mechanism operatively connected to a vehicle internal combustion engine utilizing the preferred form of control.

FIG. 5 illustrates the preferred form of control for the cam timing mechanism. A controller 162 receives input signals 160 from sensing devices (not shown) which correspond to selected engine operating conditions. The controller 162 is an electronic control unit which is adapted to receive the input signals and to transmit a pulse to control means 164 under certain conditions. Current is received from the battery through ignition switch 163. The controller 162 could also have additional functions as when the system of this invention is used in an emission control system which utilizes fuel injection. Thus, the controller would additionally have circuits for converting signals from the input sensors to electrical pulses to open injection valve 180 with a specified timing and duration. Such circuits are well known in the prior art.

When the input signals are at certain specified levels, the controller transmits a signal to a control means 164 for controlling the periods of application of vacuum to the bellows 110. This can consist of a 12v. d.c. solenoid three-way valve which normally vents the bellows 110 to the atmosphere through tubing 170 and 172 and filter 174. This prevents application of vacuum and locking of the mechanism in a cam advance position by retained vacuum. When actuated by the pulse from the controller 162, valve 164 will close the passage to tubing 172 and open the passage between tubing 170 and 166. This provides access from the bellows 110 to the intake manifold 168 by virtue of tube 170 being connected to vacuum passage 126.

Figure 6:
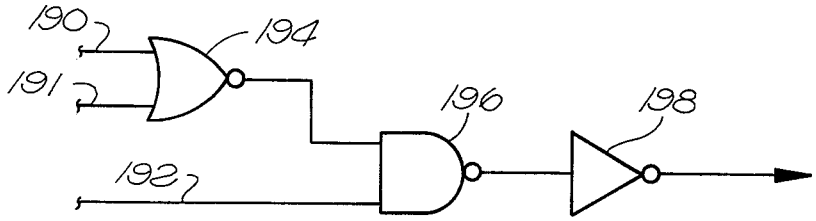
FIG. 6 shows one type of control circuit, in logic schematic form for the mechanism.

A logic circuit which can be used for the controller is illustrated in FIG. 6. Connections 190, 191, and 192 transmit input signals from the sensors. In the preferred embodiment, 190 represents engine temperature, 191 represents vehicle speed, or transmission position which is considered equivalent for purposes of this application, and 192 represents engine R.P.M. Each sensor produces either a binary 1 or a binary 0 output depending on its threshold value and the magnitude of the engine operating condition sensed. For example, with engine temperature having a threshold value of 165° F., a binary 1 output will be produced until the threshold value is exceeded, whereupon a binary 0 output is produced. Other representative threshold values are high gear position for the transmission position and 1,500 R.P.M. for engine R.P.M. In the form shown, engine R.P.M. 192 will produce a binary 1 output when its threshold value is exceeded, whereas the other sensor signals are binary 0 when the respective threshold value of the sensors is exceeded. The circuit is designed so that an output signal is produced only if signal 192 is binary 1 and signals 190 and 191 are binary 0. AND gate 196 will not produce a true signal unless both its input signals are binary 1. For the inputs to AND gate 196 to be both binary 1, engine R.P.M. must exceed its threshold value and NOR gate 194 must have both its inputs as binary 0. These inputs are binary 0 when the threshold values of each of the respective sensors is exceeded. The output of AND gate 196 is controlled to amplifier 198 which, in turn, supplies controlling current to valve 164. A signal produced will be terminated when any one or more of the engine operating conditions sensed falls below its threshold value. Thus, application of vacuum to the vacuum responsive means (bellows 110) takes place on an intermittent selected basis dependent upon engine operating conditions.

FIG. 7 illustrates a modification of the invention. The crux of the modification is the control of valve 164 for a selected application of vacuum to the bellows 110. Instead of the controller 162, sensing switches 200 and 202 are provided. For purposes of illustration, switch 200 senses temperature and switch 202 senses transmission position. The switches function as on-off switches using a fixed threshold value. For example, temperature switch 200 might have a threshold value of 165° F. and transmission switch 202 a threshold value of high gear position. When ignition switch 163 is closed, no current from the battery will pass through temperature switch 200 until the engine temperature exceeds 165° F. and no current will pass through the transmission switch until the transmission is in high gear position. Thus, no signal to activate valve 164 will reach that valve until current passes through both switches. The signal is shut off opening the passage of valve 164 to tubing 172 and thereby venting to atmosphere when one of the variables falls below the threshold value.

FIG. 8 illustrates another modification of the invention. In this modification, the control means 164, rather than being electrically actuated by other mechanisms, works automatically. This valve shown as 250, has a U-shaped top-cap portion 252 and a body portion 254. Both portions have flanged ends 256 and 258 respectively and a plurality of holes 260 and 262 respectively which are aligned against each other. Bolts 264 fasten together portions 252 and 254. A port 266 is provided on one side of cap portion 252 and connected through tubing 268 to the air intake portion 270 of an internal combustion engine. Ported vacuum is generated within the air intake depending upon the position of the throttle butterfly 72. A chambe 274 is defined by cap portion 252 and diaphram 276. A spring 278 which tends to force the diaphram 276 downward is mounted between retaining plates 280 and 282 and around cap screw 284. Retainer 282 also functions as a diaphram retainer along with retainer 286. Cap screw 284 connects the diaphram 276 to valve 286 which is reciprocable within bore 287. The force of spring 278 on diaphram 276 can be adjusted using cap screw 290 which bears against retainer 280, and is mounted in nut 292 and through bore 288 of cap portion 252. Body portion 254 has aligned transverse passages 296 and 297 and an upwardly inclined passage 294 emanating from passage 297. These passages terminate into bore 287. Valve 285 also has upper and lower circumferential grooves 303 and 304 in which are mounted O-rings 301 and 302 for sealing the vacuum flow. A channel 305 connects with groove portion 300 and extends axially downward to the bottom end of valve 285. Passage 305 connects with an axial passage 306 in bottom cap 307 which is mounted to body portion 254. A filter 315 is suitably connected to passage 306. Tubing 310 is suitably connected to passage 126 (see FIG. 5) and into connector 308 which engages passage 296 for access of the bellows up to the valve. Tubing 312 is suitably connected to the intake manifold (FIG. 5) and by connector 309 to passage 297 to provide access of the manifold vacuum to the valve.

OPERATION

With the embodiments illustrated in FIGS. 5 and 7, valve 164 will not be energized unless the threshold values of all the sensors are exceeded. When this is not the case, valve 70 will be in the position shown in FIG. 1 and the vanes in the standard position shown in FIG. 3A. The engine crankshaft through drive chain 14 rotates drive sprocket 20 and vane ring 35 which is fastened thereto. The driving vanes 36 of vane ring 35 engage the driven vanes 42 of hub-ring 40. Consequently, hub-ring 40 and camshaft 10 which is connected to hub-ring 40 are driven in timed relation to the engine crankshaft. Due to the position of valve 70 hydraulic fluid flowing through passages 60 and 64 only flows into annular areas 74 and 81 in bore 50. There is, however, a normal seepage of fluid which lubricates the moving parts and prevents wear but is insufficient to overcome the cam load torque and angularly displace vanes 42. When all the threshold values of the sensors are exceeded, valve 164 will be activated. The valve opens the passage between tubing 166 and 170 which gives access to the bellows 110 to the intake manifold vacuum through passages 125 and 126. If intake manifold vacuum is of sufficient magnitude to compress the bellows 110 overcoming the force of spring 100, valve 70 is moved to the position where portion 71 contacts flange 51 of hub-ring 40. With the valve 70 in this position, hydraulic fluid flowing from passages 60 and 64 into bore 66 flows through hole 72, annular area 74, passage 48, groove 26, and channels 27 into the chambers 152. The hydraulic fluid pressure overcomes the cam load torque and displaces vanes 42 clockwise relative to vanes 36 until vanes 42 each contact the next succeeding vane 36 as shown in FIG. 3B. Thus, the camshaft 10 which is secured to hub-ring 40 is angularly displaced relative to vane ring 35, sprocket 20, and the engine crankshaft. Should any one or more of the sensors fall below its threshold value, the signal is no longer transmitted to valve 164 and it is deactivated. This opens a passage between tubing 170 and 172 while closing the passage to tubing 166, and the vacuum passage to the bellows 110 is vented to the atmosphere. The force of spring 100 being unopposed (or when manifold vacuum falls to a level insufficient to overcome the spring force) moves valve 70 back to the position shown in FIG. 1. This eliminates the fluid pressure from chamber 152 because hole 72 is no longer aligned with passage 48. With the fluid pressure removed the cam load torque forces the vanes 42 to move counterclockwise to the standard position shown in FIG. 3A. As vanes 42 move toward this position, the fluid from chamber 152 is forced back through channel 27, groove 26, passages 48, and into the relief passages 78 of valve 70 which are now aligned with passages 48. The fluid then flows through bore 84, hole 86, into space 88, and back to the fluid supply.

The embodiment of FIG. 8 operates in the same manner except that the three way valve 250 which operates automatically is used instead of the three way valve 164 and the electronic actuation controls therefore. Ported vacuum is developed every time pressure is applied to the throttle pedal opening the throttle plate 272. When sufficient ported vacuum is present in chamber 274 to overcome the force of spring 278, the diaphram 276 rises. This lifts the valve 285 and aligns the groove 298 with passages 296 and 297 (as shown in FIG. 8). This opens a passage between the engine intake manifold and bellows 110 which allows the vanes 42 to be advanced if the magnitude of the vacuum is sufficient to overcome the force of spring 100. When ported vacuum is insufficient to overcome spring 278, as during idle or deceleration modes, the diaphram 276 and valve 285 are in their standard lower position where grooves 300 is aligned with passages 296 and 297 so that the vacuum passage to the bellows is vented to the atmosphere through passages 305 and 306 and filter 315.

The timing mechanism illustrated in the drawings advances one member from a standard or retarded position relative to a second member. Due to design and operating characteristics some applications may give more satisfactory performance results by retarding one member from a standard or advanced position. The mechanism embracing this invention may be readily modified to obtain this result while remaining within the scope of the invention. For example, the controller circuit could be changed to activate valve 164 until all input signals exceed their threshold values, whereupon value 164 would be deactivated and the camshaft retarded relative to the crankshaft.

The hydraulic timing mechanism when used to adjust the camshaft timing of a vehicle internal combustion engine, may be readily substituted in the space normally occupied by the camshaft drive gear with a minimum amount of changes. The engine oil supply can be utilized, eliminating the need for a new fluid supply system. The small size of the mechanism obviates the space problems of the prior art devices. In most internal combustion engines the lower pulley 400 and harmonic balancer 410 (FIG. 5) would have to be moved forward. However, this change can be readily accomplished by attaching an extension to the crankshaft.

Thus, it is apparent that there has been provided, in accordance with the invention, a hydraulic timing mechanism that fully satisfies the objects, aims, and advantages set forth above. While the invention has been described in conjunction with specific embodiments thereof, it is evident that many alternatives, modifications, and variations will be apparent to those skilled in the art. Accordingly, it is intended to embrace all such alternatives, modifications, and variations as fall within the spirit and scope of the appended claims.

What is claimed is:

1. In an internal combustion engine having an intake manifold, a crank shaft, and a cam shaft, a fluid actuated timing mechanism comprising:

a drive member operatively connected for rotation with the crank shaft, a driven member operatively connected with the cam shaft, whereby relative displacement of said drive member and said driven member rotationally displaces the engine cam shaft relative to the engine crank shaft, vacuum responsive means to relatively displace said drive member and driven member, a line connecting the intake manifold to said vacuum responsive means, and vacuum control means in said line for controlling application of vacuum to said vacuum responsive means.

2. Apparatus as set out in claim 1 wherein the internal combustion engine is incorporated in a vehicle and said vacuum control means comprises a valve, sensing means to sense vehicle operating conditions, and transmitting means responsive to said sensing means to selectively transmit a signal to activate said valve to allow the application of vaccum to said vacuum responsive means.

3. Apparatus as set out in claim 2 wherein said sensing means senses engine temperature and vehicle speed.

4. In an internal combustion engine having an intake manifold, a timing mechanism actuated by hydraulic fluid comprising:

a drive member, a driven member, said drive member and driven member forming a fluid pressure chamber therebetween, vacuum responsive means for regulating the hydraulic fluid in said chamber to relatively displace said drive member and driven member, said vacuum responsive means including a flow governor means which is selectively positioned within said driven member to allow fluid influx to said chamber and fluid efflux from said chamber, a line connecting the intake manifold to said vacuum responsive means, and vacuum control means in said line for controlling the application of vacuum to said vacuum responsive means.

5. Apparatus as set out in claim 4 wherein said vacuum responsive means also includes a bellows connected to said flow governor means.

6. Apparatus as set out in claim 4 wherein the internal combustion engine is incorporated in a vehicle has a crankshaft and camshaft, said drive member is operatively connected for rotation with the crankshaft and said driven member is operatively connected with the camshaft, whereby relative displacement of said drive member and said driven member rotationally displaces the engine camshaft relative to the engine crankshaft.

7. Apparatus as set out in claim 6 wherein said vacuum control means comprises a valve, sensing means to sense vehicle operating conditions, and transmitting means responsive to said sensing means to selectively transmit an activating signal to activate said valve to allow the application of vacuum to said vacuum responsive means.

8. Apparatus as set out in claim 6 wherein the engine has a throttle, and said vacuum control means is responsive to position of the throttle.

9. Apparatus as set out in claim 7 wherein said transmitting means receives input signals from said sensing means and transmits said activating signal only when all said input signals from said sensing means are representative of all said sensed vehicle operating conditions being in excess of preselected values.

10. Apparatus as set out in claim 7 wherein the engine has fuel injectors, and said transmitting means also transmits signals to open the fuel injectors in response to said input signals.

11. Apparatus as set out in claim 9 wherein said sensing means senses engine R.P.M., engine temperature, vehicle speed, and wherein said vacuum responsive means is responsive to intake manifold vacuum.

12. Apparatus as set out in claim 7 wherein said sensing means senses engine temperature and vehicle speed, and wherein said vacuum responsive means is responsive to intake manifold vacuum.

13. Apparatus as set out in claim 4 also including a sprocket having an outer cylindrical wall and an inner cylindrical hub which are joined by an intermediate radial wall, said outer wall, said inner hub, and said radial wall, forming an annular cavity therebetween, and wherein said drive member is a ring with a plurality of drive vanes fixedly connected thereto, said drive member is operatively connected for rotation with said sprocket, and said drive vanes are located within said cavity.

14. Apparatus as set out in claim 13 wherein said driven member has a hub fitted within the inner hub of said sprocket, a ring attached to said hub and extnding radially extending therefrom, and a plurality of driven vanes fixedly connected to said ring, said driven vanes located within said cavity circumferentially spaced and coaxial with said drive vanes of said drive member.

15. Apparatus as set out in claim 8 wherein said vacuum control means includes a diaphram and a movable member attached to said diaphram, and wherein the position of said movable member governs the application of vacuum to said vacuum responsive means.

16. A timing mechanism actuated by hydraulic fluid comprising:

a drive member, said drive member having a ring of spaced drive vanes attached thereto, a driven member, said driven member having a ring of spaced driven vanes attached thereto, said driven vanes positioned coaxial with and circumferentially spaced from said drive vanes, and vacuum responsive means for delivering hydraulic fluid under pressure intermediate said vanes, said vacuum responsive means including a flow governor means which is selectively positioned with said driven member to allow fluid influx and efflux intermediate said vanes to relatively displace said drive vanes and said driven vanes.

* * * * *